US006389975B1

(12) United States Patent
Haddon et al.

(10) Patent No.: US 6,389,975 B1
(45) Date of Patent: May 21, 2002

(54) TRANSISTORIZED HIGH-VOLTAGE CIRCUIT SUITABLE FOR INITIATING A DETONATOR

(75) Inventors: Michael D. Haddon; Gabriel H. Soto, both of Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/558,690

(22) Filed: Apr. 24, 2000

(51) Int. Cl.[7] ..... F42C 11/00

(52) U.S. Cl. ..... 102/219; 102/206; 102/218; 102/219; 102/202.8

(58) Field of Search ..... 102/219, 218, 102/202.8, 216, 206

(56) References Cited

U.S. PATENT DOCUMENTS

| | | | | |
|---|---|---|---|---|
| 3,275,891 A | | 9/1966 | Swanson | |
| 3,492,532 A | | 1/1970 | Fayling | |
| 3,967,557 A | * | 7/1976 | Irish, Jr. | 102/216 |
| 4,296,688 A | | 10/1981 | Orlandi | |
| 4,510,844 A | * | 4/1985 | Fritz et al. | 89/35 |
| 4,559,875 A | | 12/1985 | Marshall | |
| 4,934,268 A | | 6/1990 | Levin | |
| 5,249,095 A | | 9/1993 | Hunter | |
| 5,347,929 A | | 9/1994 | Lerche et al. | |
| 5,436,791 A | | 7/1995 | Turano et al. | |
| 5,444,596 A | | 8/1995 | Aresco | |
| 5,465,030 A | * | 11/1995 | Smith | |
| 5,641,935 A | | 6/1997 | Hunter et al. | |
| 5,731,538 A | | 3/1998 | O'Brien et al. | |
| 5,854,732 A | | 12/1998 | Murray | |
| 6,105,688 A | * | 8/2000 | Vaynshteyn et al. | 102/312 |
| 6,144,170 A | * | 11/2000 | Beland et al. | |

* cited by examiner

*Primary Examiner*—Michael J. Carone
*Assistant Examiner*—Lulit Semunegus
(74) *Attorney, Agent, or Firm*—Earl H. Baugher; Anthony J. Serventi; David S. Kalmbaugh

(57) ABSTRACT

Disclosed, in a preferred embodiment, is a switching circuit incorporating a Field Effect Transistor (FET), two series dual-tap gas tube surge arrestors, and high-voltage resistors as part of a high voltage switch of a fireset for initiating an exploding foil initiator (EFI). Until energizing the FET via a firing command, an operating voltage of 1000 V is held off by a combination of the surge arrestors and high-voltage resistors. Upon receipt of a firing signal, a 28 V source is used to energize the FET that, in turn, decreases the voltage across the one surge arrestor connected directly to ground and increases the voltage across the other surge arrestor. Upon reaching the breakdown voltage of the ionizable gas within the second surge arrestor, the gas ionizes, becomes electrically conductive, and dumps the second surge arrestor's voltage across the first surge arrestor. This causes the first surge arrestor to also break down. Both surge arrestors are now conducting. Thus, the 1000 V source is free to energize the remainder of the circuit, discharging a 0.20 $\mu$f capacitor through the EFI. The breakdown of both arrestors occurs in nanoseconds, enabling an almost instantaneous initiation signal.

14 Claims, 4 Drawing Sheets

TRANSISTORIZED HIGH-VOLTAGE CIRCUIT SUITABLE FOR INITIATING A DETONATOR

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

A transistorized high-voltage switch. In particular, a preferred embodiment of the present invention replaces conventional spark gap circuits used in a fireset incorporating an exploding foil initiator (EFI).

BACKGROUND

In high voltage switching circuits incorporating an EFI, for example, conduction may be initiated through a dielectric by the complete dielectric breakdown between electrodes separated by the dielectric, e.g., air. Closing a switch allows energy to pass from a high-voltage power supply across the electrodes to the EFI. Switches with high voltage ratings, i.e., kilovolts (kV), are needed to hold off the voltages used with an energy storage capacitor, i.e., 1–3 kV, for a single EFI. When triggered, such switches should produce a pulse having a fast rise time in order to properly initiate the EFI. Typical pulses have stored energies of 0.1–0.6 milli-Joules (mJ), rise times of 30–60 nanoseconds (ns), peak currents of 1–7 kiloamps (kA), and peak powers of 1–15 megawatts (MW).

A typical spark gap device incorporates an ionizable gas in a chamber separating two electrodes. Spark gap devices are usually coupled in parallel with a circuit or device to be used only upon a deliberate initiation, e.g., an EFI. When the electrical potential across the load and across the spark gap reaches the breakdown voltage for the ionizable gas, the gas ionizes, and current flow is established between the electrodes. For applications in which spark gap switches have been used in over voltage and over current protection circuits, this breakdown shunts the high potential around the circuit or device being protected. For applications in which the intent is to deliver a high voltage that has been "held off" an initiator such as an EFI, the current is used to discharge a capacitor, thus delivering the necessary initiation current to the EFI.

Spark gap devices have been used to switch currents to other devices, as known from U.S. Pat. No. 3,275,891 issued to Swanson, September 1966. Such triggered spark gaps work well when the switching application requires rapid switch closure, but do not work well when rapid opening of the switch is required, as in the case of an over voltage protection circuit. Triggered spark gaps do not allow rapid and successive application of high voltage because the ionized gas in a triggered spark gap does not de-ionize rapidly. De-ionization is slow because the arc is surrounded by gas that does not allow the arc to cool rapidly. Using an electric field to activate a particular kind of switch is disclosed in U.S. Pat. No. 3,492,532 issued to Fayling, January 1970. An ionized flow path in a spark gap device is used to displace a liquid magnetic and electrically conductive material into a position inside the spark gap device which physically connects the electrodes, thus replacing the ionized gas flow path with a direct connection. A recent application of spark gaps in firesets includes a "microgap" in series with a high-voltage two electrode spark gap as disclosed in U.S. Pat. No. 5,641,935, Electronic Switching for Triggering Firing of Munitions, issued to Hunter et al, Jun. 24, 1997.

Alternatives to conventional spark gap switches have been proposed such as a device that requires moving parts as disclosed in U.S. Pat. No. 5,854,732, High Voltage Arcing Switch Initiated by a Disruption of the Electric Field, issued to Murray, Dec. 29, 1998. Although this switch is capable of handling voltages to 25 kV, it also requires a large package and because of the requirement for moving parts, it does not have an outstanding response time. Another alternative is the electrical safe arm device as disclosed in U.S. Pat. No. 5,436,791, Perforating Gun Using an Electrical Safe Arm Device and a Capacitor Exploding Foil Initiator Device, issued to Turano et al, Jul. 25, 1995 or U.S. Pat. No. 5,444,598, Capacitor Exploding Foil Initiator Device, issued to Aresco, Aug. 22, 1995. Although effective, these devices require complicated circuitry, a high voltage source on the order of 3 kV, and are not capable of outstanding response times.

Although transistors have been used in circuits for firing a detonator, these circuits have generally been low-voltage spark gap circuits, an example of which is U.S. Pat. No. 4,296,688, Electronic Circuit for Firing a Detonator, issued to Orlandi, Oct. 27, 1981. Further, the response time for these circuits is on the order of hundreds of milliseconds. Another example that seeks to avoid the bulk of a typical spark gap circuit is disclosed in U.S. Pat. No. 4,559,875, High Energy Switching Circuit for Initiator Means of the Like and Method Therefor, issued to Marshall, Dec. 24, 1985. This switch is intended for one-time use and consists of a number of junction diodes in series, providing the necessary reverse standoff voltage for a high-voltage source on the order of 3000 V. Yet another recent "one-shot" switch is disclosed in U.S. Pat. No. 5,249,095, Laser Initiated Dielectric Breakdown Switch, issued to Hunter, Sep. 28, 1993, wherein light from a laser source, possibly a laser diode, shines on dielectric material between two electrodes and initiates break down.

A commonly used spark gap switch is the ceramic-bodied, hard-brazed, miniature spark gap, incorporating either a vacuum or an ionizable-gas filled volume. Spark gaps require hermetic sealing, are expensive, have marginal reliability, a short operating life, and require expensive high-voltage trigger circuits. One other switch in use for this application is the explosively initiated shock conduction switch that uses a primary explosive detonator. This switch presents handling problems, producing chemical contamination and possible impact damage to nearby electronics.

Putting a high-voltage transistor in series with a component that has known electrical potential breakdown characteristics provides a simpler, less expensive, more durable and reliable circuit capable of repeated firings with outstanding response times and repeatability.

SUMMARY OF THE INVENTION

A preferred embodiment of the present invention envisions a dual-tube fireset incorporating two gas tube surge arrestors as part of a high voltage switch for switching a voltage on the order of 1000 V. Until a high-voltage Field Effect Transistor (FET) is energized, operating voltage is held off by the series combination of the surge arrestors and high-voltage resistors. Upon energizing the FET via a fire signal enabling a 28 V source, the voltage across the lower surge arrestor decreases and the voltage across the upper surge arrestor increases. Upon reaching the breakdown voltage in the upper surge arrestor, the gas inside the tube ionizes, becomes electrically conductive, and, upon breaking down, dumps its voltage across the lower surge arrestor. This causes the lower surge arrestor to also break down. Since both surge arrestors are now conducting and the 1000 V source is free to energize the circuit, the capacitor is discharged through the EFI. The breakdown of both arrestors occurs in nanoseconds. A high resistance bleed resistor is connected in parallel with the discharged capacitor. It will be used to bleed off the capacitor's charge in the event that the EFI is not to be initiated.

In a preferred embodiment representing a fireset incorporating an EFI, the 28 V source supplies energy for discharging a capacitor into the gate of the FET, initiated by a 5 V firing signal and limited by a resistor in series with the gate of the FET. Switching is enabled in less than 0.1 $\mu$sec, with excellent repeatability, durability, and reliability.

Advantages of preferred embodiments of the present invention as compared to switching and controls in existing firesets, in particular firesets employing spark-gap devices, include:

- much faster response times, i.e., small delay and rise times for the electrical pulse;
- long life over a wide operating temperature range, −54° C. (−65° F.)–88° C. (190° F.);
- reduced size, providing inherent advantages for hermetic sealing of the circuit;
- fewer and smaller components able to be purchased as COTS items;
- reduced system capital costs;
- the current to fire the EFI does not transit the FET;
- increased operational readiness;
- low maintenance costs;
- high durability;
- increased flexibility;
- high reliability;
- particularly suitable for modification and upgrade; and
- readily applied to existing systems.

Embodiments of the present invention can be applied to any situation in which reliable repeated firing of an initiator is desired. Incorporating the invention into a design saves capital as well as operations and maintenance costs.

Preferred embodiments are fully disclosed below, albeit without placing limitations thereon.

DETAILED DESCRIPTION

Figure 1:
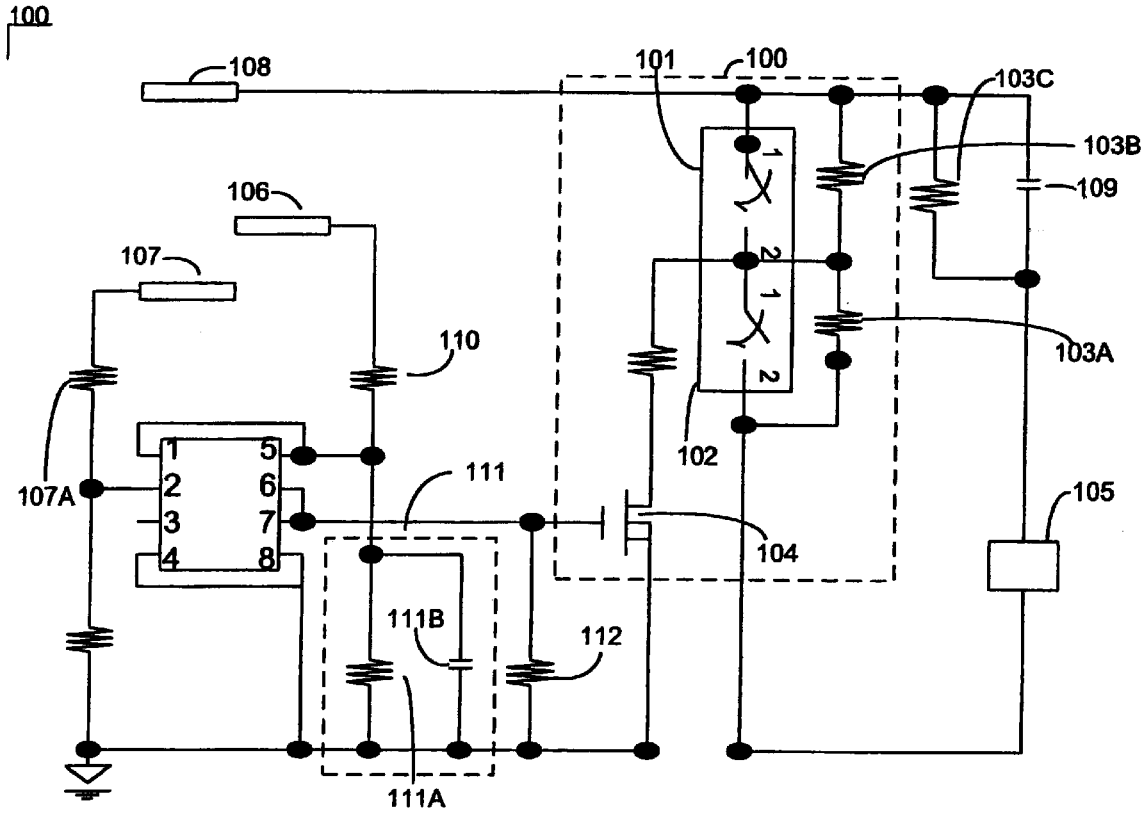
FIG. 1 is a circuit diagram of a preferred embodiment of the present invention.

Refer to FIG. 1. A preferred embodiment of the present invention envisions a dual-tube fireset incorporating two gas tube surge arrestors 101 and 102 as part of a high voltage switch 100, in turn, part of a fireset (not separately shown). Until a Field Effect Transistor (FET) 104 is energized, operating voltage of a 1000 V source 108 is held off by the series combination of surge arrestors 101 and 102 and high-voltage resistors 103A, 103B and 103C. Upon energizing the FET 104 via a fire signal 107 enabling a 28 V source 106 that discharges a capacitor 111B, the voltage across the lower surge arrestor 102 decreases and the voltage across the upper surge arrestor 101 increases. Upon reaching the breakdown voltage in the upper surge arrestor 101, the gas (not separately shown) inside the tube ionizes, becomes electrically conductive, and, upon breaking down, dumps the accumulated voltage across the lower surge arrestor 102. This causes the lower surge arrestor 102 to break down also. Since both surge arrestors 101 and 102 are now conducting and the 1000 V source 108 is free to energize the circuit, the high-energy storage capacitor 109 is discharged through the EFI 105. The breakdown of both arrestors 101 and 102 occurs in nanoseconds. A high resistance bleed resistor 110 is connected in parallel with the capacitor 109. It is used to bleed off the capacitor's charge in the event that the EFI 105 is not to be initiated.

Again referring to FIG. 1, the complete operation of a fireset incorporating a preferred embodiment of the present invention can be seen. The 28 V source 106 is initiated by a fire signal 107 through a current limiter (limiting resistor) 107A. The 28 V source, reduced by the voltage drop across a 5.1 kΩ resistor 110, activates the RC circuit 111, represented by a 3.48 kΩ resistor 111A and a 0.1 $\mu$f capacitor 111B. Once the capacitor 111B discharges, an activating current is supplied to the FET 104, as limited by the 100Ω resistor 112.

Results of tests conducted on a preferred embodiment of the present invention are presented in FIGS. 2–6. The circuit was tested for performance, durability, reliability, and environmental robustness over its designed operating range. The test setup (not separately shown) included an oscilloscope for recording the current and trigger pulse, a multimeter having a high-voltage probe, a high-voltage (1000 V) DC power supply, a low-voltage (28 V) DC power supply, and a function generator for providing a periodic 5 V signal indicating a firing command. To provide a "before and after" evaluation, the gas tubes and capacitors were measured initially.

Referring to FIG. 1, the EFI 105 was replaced with a CVR (not separately shown) and the remaining circuit elements were then tested. During the multiple cycling of the circuit, the following parameters were measured (as a function of the number of operating cycles experienced) and stored on the oscilloscope: peak current, rise time, delay time, and jitter time. Additionally the same four parameters were measured as a function of operating temperature.

The test procedure was as follows:

a. The circuit 100 was instrumented so that measurements for the above parameters could be taken. A thermocouple and electrical sensors (not separately shown) were attached and the circuit placed into a thermal test chamber (not separately shown). A 0.5ΩCVR simulated the EFI 105 for the temperature tests.

b. The circuit 100 was charged to 1000 V.

c. The circuit 100 was then repeatedly charged and fired at operating temperatures from 54° C.–91° C. in 12° C. increments, with the above measurements taken for each operating cycle.

d. At the end of this string of cycling, the circuit 100 was then fired an additional ten times at 91° C.

e. The circuit 100 was then allowed to cool and the function generator (not separately shown) was connected. The function generator was programmed to fire the circuit 100 automatically at regular intervals of 16 sec. The oscilloscope (not separately shown) was set in "persistence mode" in order to superimpose a picture of the waveform response for each cycle on the display.

Figure 2:
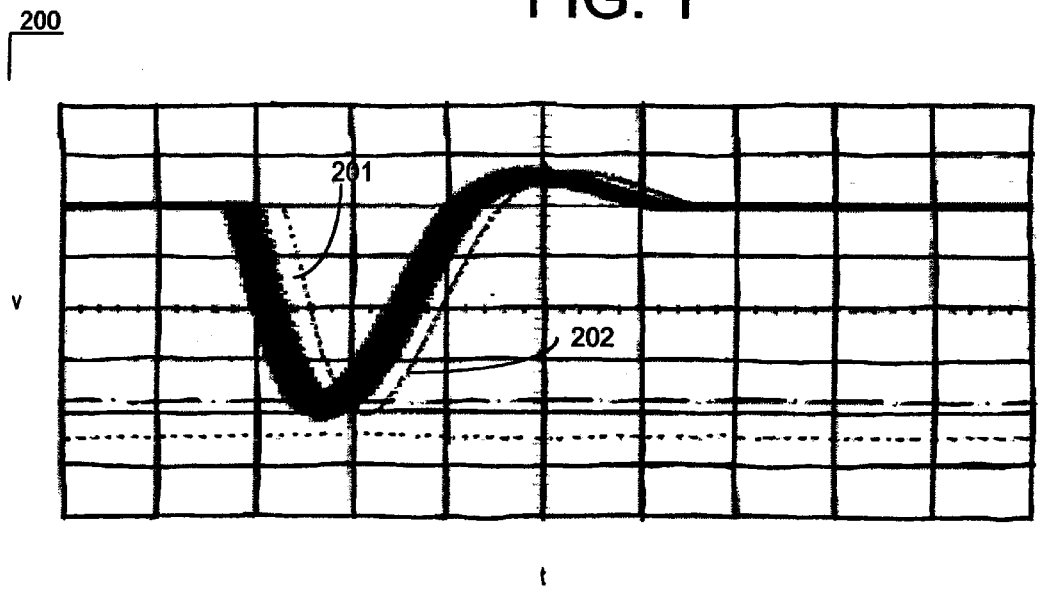
FIG. 2 is a representation of a composite of oscilloscope traces that summarizes environmental testing of a preferred embodiment of the present invention for 3296 cycles.

FIG. 2 is a plot 200 of voltage versus time. It shows the overlayed traces 201 of peak pulse amplitude versus time for 3296 "shots" under the above test conditions. Note the single curve 202 to the right of the thick overlayed traces 201. This trace 202 occurred after 3200 operating cycles and was the first sign of degradation.

Figure 3:
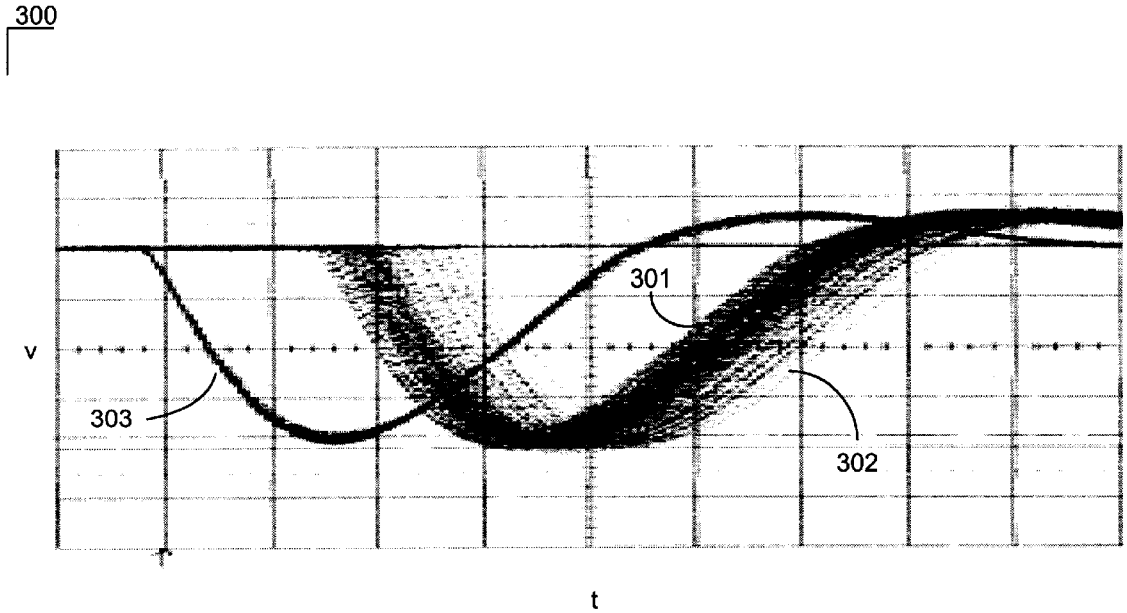
FIG. 3 is a representation of a composite of oscilloscope traces that summarizes jitter performance of a preferred embodiment of the present invention for 3296 cycles.

FIG. 3 is a plot 300 of voltage versus time. It shows the overlayed traces 301 of jitter amplitude versus time for 3296 shots under the above test conditions. Note the traces on the right 302 show operation as the circuit 100 approaches failure while the traces on the left 303 show the result of the gas tubes (surge arrestors) 101, 102 breaking down after circuit failure.

Figure 4:
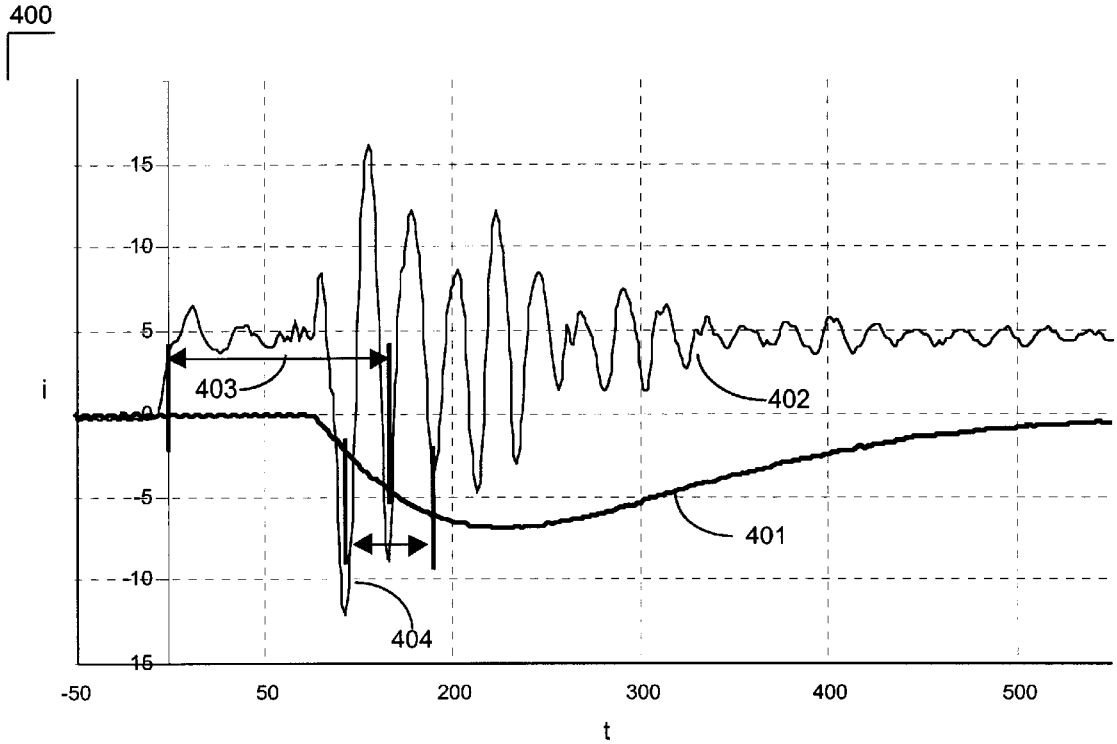
FIG. 4 displays representative delay and rise times for a preferred embodiment of the present invention.

FIG. 4 is a plot 400 of current versus time. It depicts how individual delay and rise times were measured for individual traces 401 and 402. Delay time, $T_D$ 403, is measured from the 50% point of the trigger signal 402 (5 V from the generator) to the 50% point of the current trace 401. Rise time, $T_R$ 404, is the time as measured from the 10% and 90% points on the response curve 401. Both measurements proved the excellent response of the circuit 100 throughout the testing, i.e., less than 0.1 $\mu$sec and nominally ~50 ns.

Figure 5:
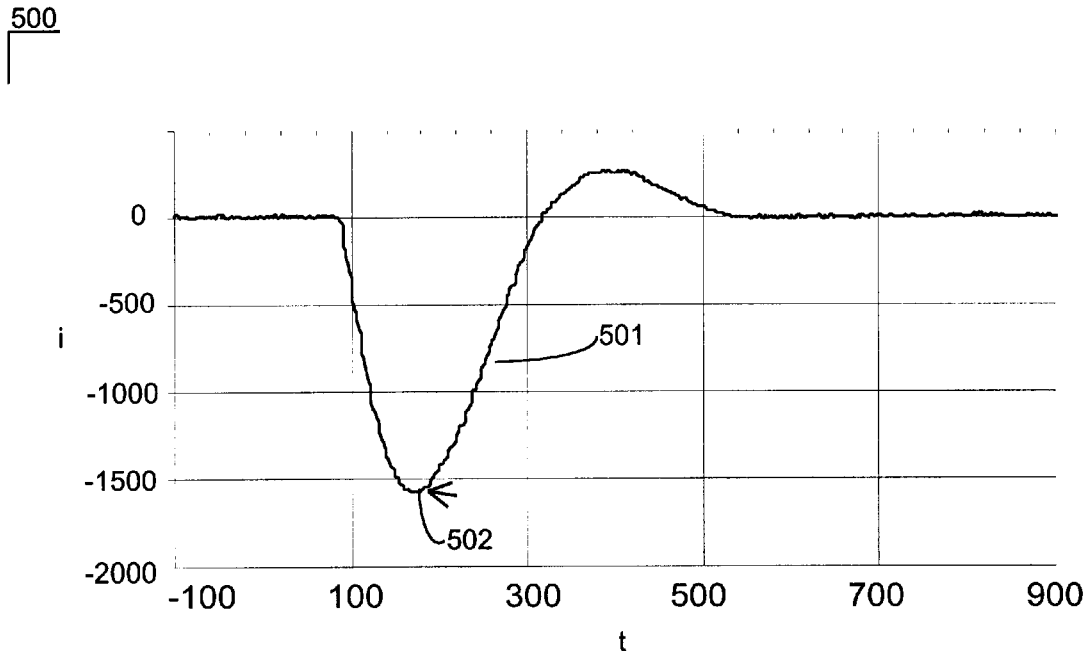
FIG. 5 is a representative current profile of a preferred embodiment of the present invention firing into a 0.005 ohm (Ω) current-viewing resistor (CVR).

FIG. 5 is a plot 500 of current versus time. It shows a typical pulse output from the circuit 100 as a trace 501 of amps versus seconds when the circuit 100 is fired into a 0.005ΩCVR 105 as a "worst case" load. The peak current 502 is approximately 1.56 kA with a rise time less than 0.1 $\mu$sec. This far exceeds the performance of a typical spark gap circuit.

Figure 6:
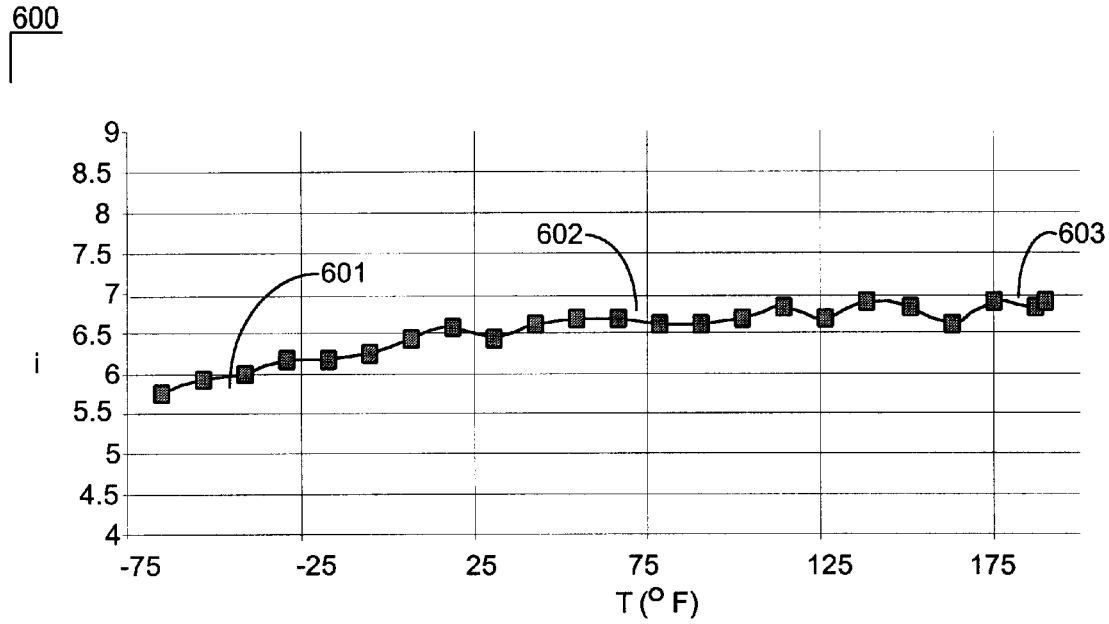
FIG. 6 relates applied current to temperature for a preferred embodiment of the present invention using a 0.5Ω CVR.

FIG. 6 is a plot 600 of current versus temperature in ° F. It depicts the performance of the circuit 100 during temperature cycling, a trace 601 depicting amps versus circuit temperature (° F.). The circuit 100 reaches a "steady-state," i.e., constant current, at about room temperature (75° F.) 602 and maintains this value to above 175° F. 603.

Figure 7:
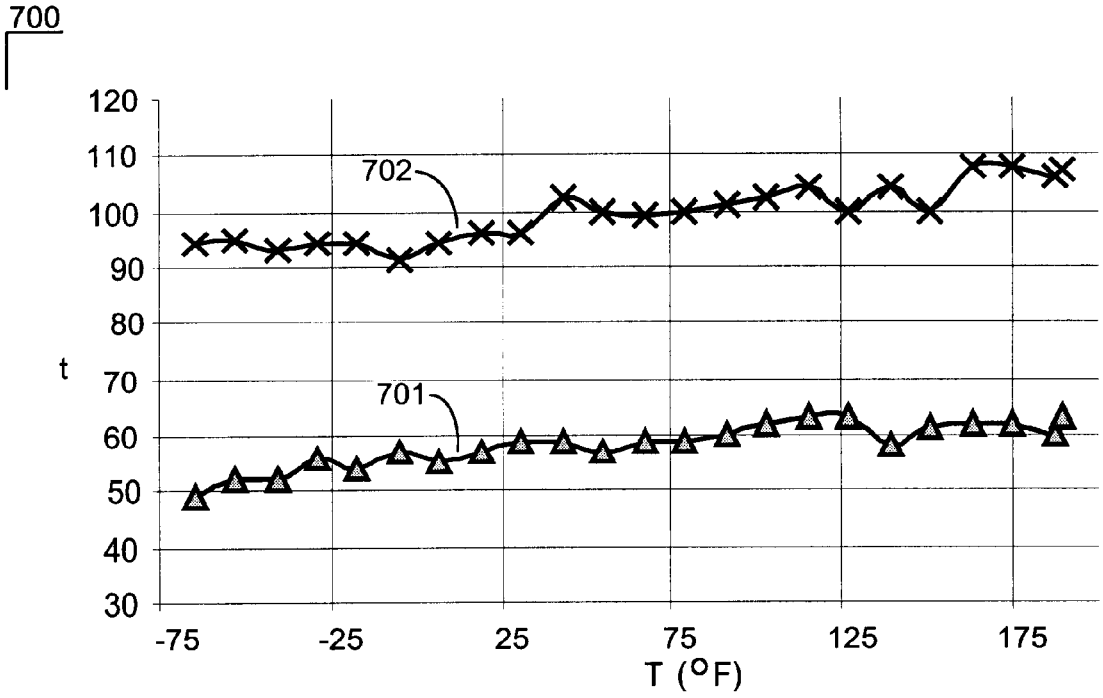
FIG. 7 shows the effects of operating temperature on both rise time and delay time for a preferred embodiment of the present invention.

FIG. 7 plots time versus temperature 700 (° F.) for both the circuit's rise time 701 and its delay time 702. Both times exhibit only a moderate, almost linear, rise over the circuit's designed operating temperature range.

Results of measuring the gas tubes (surge arrestors) 101, 102 at completion of testing revealed no change in breakdown voltages. However, both the transistor 104 and its driver (not separately shown) failed.

The above descriptions should not be construed as limiting the scope of the invention but as mere illustrations of preferred embodiments. Although examples discussed initiation of an EFI, any device that a user may need to initiate with a high energy pulse, the switching mechanism requiring a fast response time, may use an embodiment of the present invention. The scope shall be determined by appended claims as interpreted in light of the above specification.

We claim:

1. A high-voltage switch, comprising:

a high-voltage transistor;

a capacitor;

a resistor connected in parallel to said capacitor, said resistor and said capacitor forming an RC circuit, an upper gas tube and a lower gas tube, said upper and lower gas tubes operably connected in series to said high-voltage transistor and said RC circuit, said upper and lower gas tubes containing an ionizable gas;

a first current limiter, said first current limiter operably connected in parallel with said upper gas tube, a second current limiter, said second current limiter operably connected in parallel with said lower gas tube; and wherein a voltage from said high-voltage transistor causes a serial breakdown of said ionizable gas in said upper and lower gas tubes, said serial breakdown enabling said capacitor to discharge.

2. The switch of claim 1 wherein said high-voltage transistor is a field effect transistor (FET).

3. The switch of claim 1 wherein said upper and lower gas tubes are surge arrestors.

4. The switch of claim 1 wherein said first and second current limiters are high-voltage resistors.

5. A method for providing energy to an initiator, comprising:

limiting a current prior to initiation of an electrical event;

initiating said electrical event;

decreasing a first electrical potential, as a result of such initiation, across one gas tube of a pair of gas tubes, each containing an ionizable gas, said gas tubes being serially connected;

increasing a second electrical potential across the second of said pair of gas tubes as a result of decreasing said first electrical potential across said first gas tube, wherein said ionizable gas in said second tube ionizes and becomes conductive, and wherein said second electrical potential increases to a breakdown threshold voltage causing a current to flow into said first gas tube from said second gas tube; and causing said current to flow through an initiator from a charged capacitor wherein said capacitor is serially connected to said gas tubes and said initiator.

6. The method of claim 5 energizing a field effect transistor (FET) as said electrical event.

7. The method of claim 5 using high-voltage resistors to limit said current.

8. The method of claim 5 using surge arrestors as said gas tubes.

9. The method of claim 5 initiating via a fire signal enabling a low voltage source to discharge a capacitor and permit a current to flow to said FET.

10. The method of claim 9 wherein said low voltage source is operably connected in series to a current limiter and an RC circuit containing said capacitor.

11. A transistorized fireset, comprising:

first and second capacitors;

a high-voltage transistor;

gas tubes, operably connected in series to said transistor and said second capacitor; and first current limiters operably connected in parallel to said gas tubes;

a second current limiter operably connected in parallel to said first capacitor, forming an RC circuit;

a third current limiter operably connected in parallel to said second capacitor; and a fourth current limiter operably connected in parallel to said RC circuit, wherein, initiation of a firing signal permits a low-voltage source to provide current to discharge said first capacitor, in turn, supplying a first activation current, limited by said fourth current limiter, to said high-voltage transistor, and wherein, serial breakdown of said gas tubes permits a high-voltage source to provide a second current to discharge said second capacitor, in turn, supplying a third current sufficient to activate an initiator.

12. The fireset of claim 11 wherein said high-voltage transistor is a field effect transistor (FET).

13. The fireset of claim 11 wherein said gas tubes are surge arrestors.

14. The fireset of claim 11 wherein said first and third current limiters are high-voltage resistors and said second and fourth current limiters are resistors.

* * * * *